US010367274B2

(12) United States Patent
Davidson, Jr. et al.

(10) Patent No.: US 10,367,274 B2
(45) **Date of Patent: *Jul. 30, 2019**

(54) BODY CLAMP CONNECTOR

(71) Applicant: PERFECTVISION MANUFACTURING, INC., Little Rock, AR (US)

(72) Inventors: Charles Darwin Davidson, Jr., Little Rock, AR (US); Robert J. Chastain, Maumelle, AR (US); Glen David Shaw, Conway, AR (US)

(73) Assignee: PERFECTVISION MANUFACTURING, INC, Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/034,971

(22) Filed: Jul. 13, 2018

(65) Prior Publication Data

US 2018/0337468 A1 Nov. 22, 2018

Related U.S. Application Data

(63) Continuation of application No. 15/168,177, filed on May 30, 2016, now Pat. No. 10,027,040, which is a continuation-in-part of application No. 14/791,395, filed on Jul. 3, 2015, now Pat. No. 9,356,364, which is a continuation-in-part of application No. 14/540,995, filed on Nov. 13, 2014, now Pat. No. 9,077,089, which is a continuation-in-part of application No. 14/245,919, filed on Apr. 4, 2014, now Pat. No. 9,105,988.

(60) Provisional application No. 62/218,452, filed on Sep. 17, 2015, provisional application No. 61/822,834, filed on May 13, 2013.

(51) Int. Cl.
*H01R 9/05* (2006.01)
*H01R 103/00* (2006.01)

(52) U.S. Cl.
CPC ..... *H01R 9/0512* (2013.01); *H01R 9/0521* (2013.01); *H01R 9/0527* (2013.01); *H01R 2103/00* (2013.01)

(58) Field of Classification Search
CPC ..... H01R 2103/00; H01R 9/0521; H01R 9/0512; H01R 9/0527
USPC ..... 439/585, 584, 583, 578
See application file for complete search history.

(56) References Cited

U.S. PATENT DOCUMENTS

| | | | | |
|---|---|---|---|---|
| 6,352,448 | B1 * | 3/2002 | Holliday | H01R 9/0521 439/585 |
| 7,189,114 | B1 | 3/2007 | Burris et al. | |
| 7,311,554 | B1 | 12/2007 | Jackson et al. | |
| 7,892,024 | B1 * | 2/2011 | Chen | H01R 13/6583 439/578 |
| 9,077,089 | B2 * | 7/2015 | Chastain | H01R 9/0512 |
| 9,105,988 | B2 * | 8/2015 | Chastain | H01R 9/0512 |
| 9,190,773 | B2 | 11/2015 | Shaw | |
| 9,203,167 | B2 * | 12/2015 | Holliday | H01R 9/05 |

(Continued)

FOREIGN PATENT DOCUMENTS

JP 2010146836 A 7/2010

*Primary Examiner* — Abdullah A Riyami
*Assistant Examiner* — Nelson R. Burgos-Guntin
(74) *Attorney, Agent, or Firm* — Paul D. Chancellor; Ocean Law

(57) ABSTRACT

A coaxial cable connector includes a shoe that is movable in a sidewall of a body of the connector and/or a continuity bus.

21 Claims, 12 Drawing Sheets

(56) References Cited

U.S. PATENT DOCUMENTS

| | | | | |
|---|---|---|---|---|
| 9,356,364 | B2 * | 5/2016 | Chastain | H01R 9/0527 |
| 2006/0146774 | A1 | 11/2006 | Buck | |
| 2007/0224880 | A1 | 9/2007 | Wlos et al. | |
| 2011/0230091 | A1 * | 9/2011 | Krenceski | H01R 9/0524<br>439/578 |
| 2011/0306236 | A1 | 12/2011 | Addario et al. | |
| 2013/0102189 | A1 | 4/2013 | Montena | |
| 2015/0340777 | A1 * | 11/2015 | Kato | H01R 9/0524<br>439/578 |
| 2015/0340778 | A1 * | 11/2015 | Chastain | H01R 9/0512<br>439/578 |
| 2016/0036138 | A1 * | 2/2016 | Burris | H01R 9/05<br>439/578 |
| 2016/0156135 | A1 * | 6/2016 | Burris | H01R 9/0521<br>439/578 |
| 2016/0285212 | A1 * | 9/2016 | Davidson, Jr. | H01R 9/0527 |

* cited by examiner (From US 7,841,896)

(From US 7,841,896)

BODY CLAMP CONNECTOR

PRIORITY CLAIM AND INCORPORATION BY REFERENCE

This application is a continuation of U.S. patent Ser. No. 15/168,177 filed May 30, 2016 which claims the benefit of U.S. Prov. Pat. App. No. 62/218,452 filed Sep. 14, 2015 and is a continuation-in-part of U.S. patent application Ser. No. 14/791,395 filed Jul. 3, 2015 (now U.S. Pat. No. 9,356,364) which is a continuation-in-part of U.S. patent application Ser. No. 14/540,995 filed Nov. 13, 2014 (now U.S. Pat. No. 9,077,089) which is a continuation-in-part of U.S. patent application Ser. No. 14/245,919 filed Apr. 4, 2014 (now U.S. Pat. No. 9,105,988) which claims the benefit of U.S. Prov. Pat. App. No. 61/822,834 filed May 13, 2013, all of which are incorporated herein by reference in their entireties and for all purposes.

BACKGROUND OF THE INVENTION

Coaxial cable connectors are well-known in various applications including those of the satellite and cable television industry. Coaxial cable connectors including F-Type connectors used in consumer applications such as cable and satellite cable connectors are a source of service calls when service is interrupted by lost and/or intermittent coaxial cable connections typically involving a junction between a male F-type connector terminating a coaxial cable and a female F-type port located on related equipment.

FIELD OF INVENTION

This invention relates to the electromechanical arts. In particular, a coaxial type connector incorporates a connector body clamp.

DISCUSSION OF THE RELATED ART

Coaxial cable connectors include variants designed to improve cable fixation and/or electrical continuity under extenuating circumstances. For example, continuity improving connectors have generally utilized assemblies of bare electrical conductors in a multipart ground circuit interconnecting an outer conductor of a coaxial cable and the grounded casing of a female F-type port.

SUMMARY OF THE INVENTION

Embodiments of the body clamp connector of the present invention provide cable fixation and/or an electrical ground path or portion(s) thereof, for example an electrical ground path between a coaxial cable outer conductor and a ground casing of a female F-type port.

In an embodiment, a male coaxial connector comprises: a hollow post that interengages a fastener and a body, the post, fastener and body in coaxial arrangement; an annular space between the body and the post, the annular space for receiving a ground conductor of a coaxial cable; and, a shoe moveable in a body sidewall window, the shoe for urging the cable ground conductor toward the post; wherein an end cap slidably engages the body and movement of the end cap from a first position on the body to a second position on the body moves the shoe and squeezes the ground conductor between the shoe and the post.

In some embodiments, moving the end cap from the first position to the second position forces the cable ground conductor against the post for fixing the cable within the connector.

In some embodiments, including an elongated electrical conductor having an arm interconnecting a base and a nib; the base inserted in the annular space, the body penetrated by the arm, and the nib located in a space between the body and the fastener; and, at least a portion of the base located between the shoe and the ground conductor of the coaxial cable; wherein moving the end cap from the first position to the second position squeezes the base portion and the ground conductor between the shoe and the post.

In an embodiment, a method of engaging a coaxial connector and a coaxial cable, the method comprises the steps of: providing a coaxial connector having a post that couples to a rotatable fastener and a body, the post, fastener, and body in coaxial arrangement about a central axis; slidably mating an end cap with the body; providing an annular space substantially defined between a body sidewall and the post, the annular space receiving a coaxial cable ground conductor; locating a shoe radially movable with respect to the post in the body sidewall, a portion of the shoe projecting from the sidewall; and, fixing the connector to the cable by moving the shoe toward the central axis to squeeze the ground conductor between the shoe and the post when the end cap slides over the projecting portion of the shoe.

In some embodiments, providing a continuity bus with first and second ends; contacting the fastener with the first end of the continuity bus; and electrically interconnecting the fastener and the cable ground conductor by urging the second end of the continuity bus to contact the cable ground conductor when the end cap slides over the projecting portion of the shoe.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

DETAILED DESCRIPTION OF THE PREFERRED EMBODIMENTS

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions. The disclosure provided in the following pages describes examples of some embodiments of the invention. The designs, figures, and descriptions are non-limiting examples of selected embodiments of the invention. For example, other embodiments of the disclosed device may or may not include the features described herein. Moreover, disclosed advantages and benefits may apply to only certain embodiments of the invention and should not be used to limit the disclosed inventions. As used herein, coupled means directly or indirectly connected by a suitable means known to persons of ordinary skill in the art. Coupled items may include interposed features such as, for example, A is coupled to C via B. Unless otherwise stated, the type of coupling, whether it be mechanical, electrical, fluid, optical, radiation, or other is indicated by the context in which the term is used. For ease of reading, applicant may mention the number of a particular annotated item only once in each paragraph. And, where a number is mentioned, it may refer to the preceding noun phrase and not an interposed prepositional phrase. For example, "the left side of the arch 111 . . . " directs the reader to look in a related figure for the arch left side which bears the number 111. Applicant may also use a phrase like "the left side 111 of the arch 110" where the context suggests a need exists to distinguish the arch 110 from the left side of the arch 111, for example where "arch 110" is mentioned for the first time.

Figure 1A:
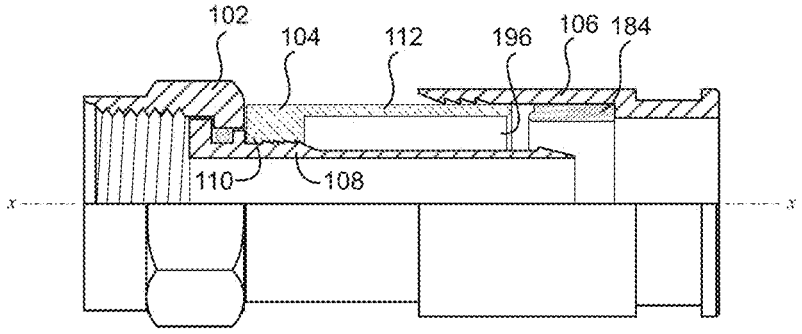
FIGS. 1A-B show coaxial connectors of U.S. Pat. No. 7,841,896.
Figure 1B:
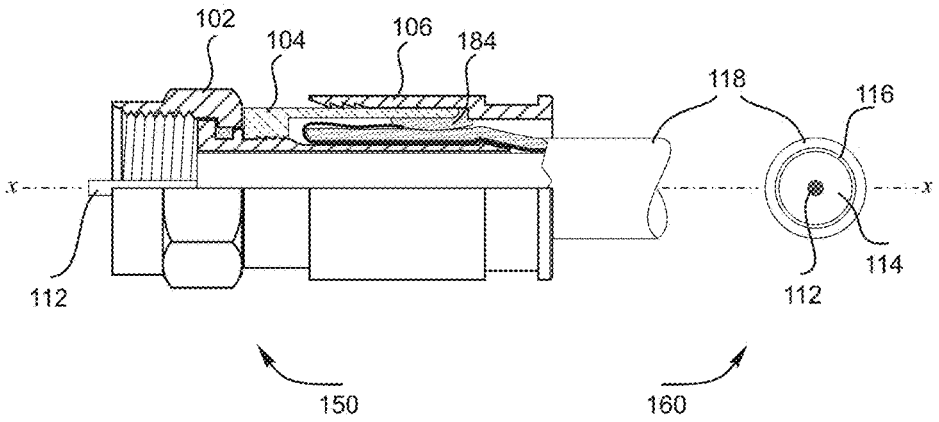

FIGS. 1A and 1B show cross sections 100A-B of F type coaxial cable connectors of U.S. Pat. No. 7,841,896. Connector parts are coaxially arranged about a central axis x-x. Connector parts include a central post 108 that interengages a fastener such as a rotatable fastener 102 and a body 104. An end cap 106 engages a trailing end of the connector body such that the connector has a somewhat telescopic structure.

As seen in FIG. 1A, the connector body includes a forward neck 110 for engaging the post and a trailing sleeve 112 for receiving a coaxial cable 160. Notably, as seen in the figure the trailing sleeve is typically an unbroken figure of revolution about the central axis x-x.

As seen in FIG. 1B, a coaxial cable 160 is inserted into the connector 150 and the end cap 106 is moved toward the fastener 102 such that a plug or wedge 184 carried within the end cap is forced into an annulus 196 between the body and the post to fix the coaxial cable by pressing it against the post 108.

Typical coaxial cable such as Series-6 type coaxial cable may include one or more layers of radio frequency (RF) shielding provided by ground conductors. For example, one type of shielding is a conductive tape or foil that attenuates interfering electromagnetic fields at higher frequencies. Another common type of shielding is a conductive braid that attenuates interfering electromagnetic fields at lower frequencies. A typical tri-shield coaxial cable may include a center conductor surrounded by a dielectric, an inner tape, a braid, an outer tape, and a jacket.

As shown, the coaxial cable 160 includes a central conductor 112 encircled by dielectric material 114. The dielectric is encircled by a ground conductor braid 116 which is in turn encircled by an outer insulating jacket 118. Not shown are other ground conductors such one or more foil layers to either side of the ground conductor braid.

Figure 2A:
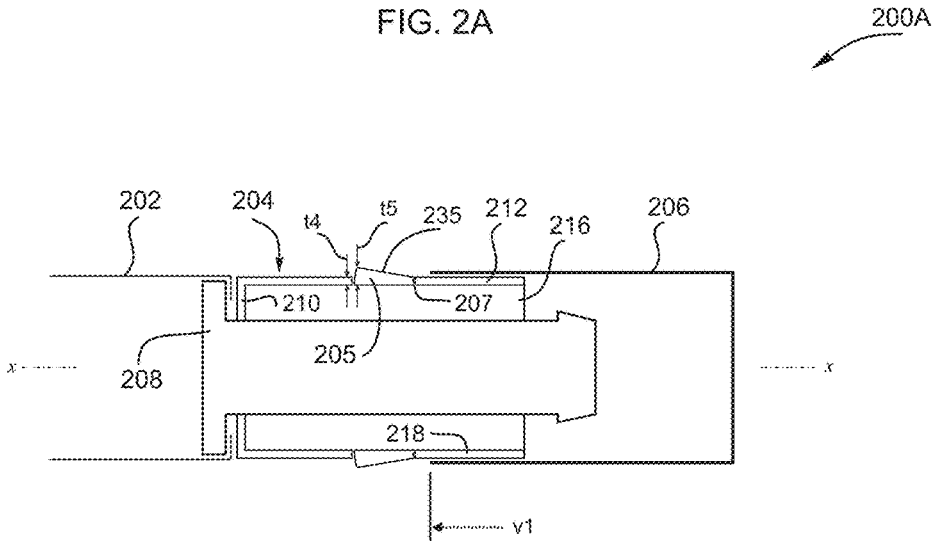
FIG. 2A shows a body clamp connector of the present invention in a first configuration.
Figure 2B:
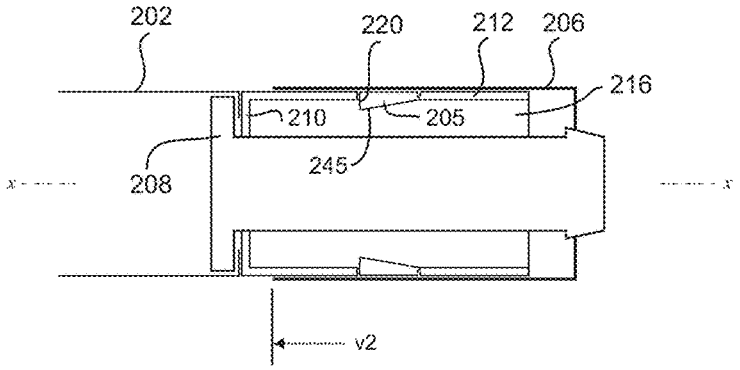
FIG. 2B shows the body claim connector of FIG. 2A in a second configuration.

FIGS. 2A and 2B show schematic cross-sections 200A-B of a body clamp connector of the present invention. In this embodiment, the connector may include an optional fastener such as a rotatable fastener 202, a body or shoe support 204, an end cap or compression part 206, and a post or axle 208.

The body 204 may be made from a conductor such as a metal or copper alloy or from a non-conductor such as a plastic. The fastener 202 is typically made from an electrical conductor such as a metal as is the post 208. In some embodiments, the post may be made from a metal base material such as a copper alloy that is plated with tin to enable a malleable fit between the post and the fastener.

In FIG. 2A, the end cap 206 is in a first position "v1" engaging only a trailing portion of the body 212. In FIG. 2B, the end cap is in a second position "v2" such that it substantially covers the body. Note that in FIG. 2B a coaxial cable 160 is omitted for clarity.

Here, the body 204 is not an unbroken figure of revolution with a neck 210 engaging the post 208. Rather, the body includes a tongue or shoe such as an integral shoe 205 with a hinge or web part 207 interconnecting the shoe and a body wall 218. The body 204, end cap 206 and shoe 205 are configured such that movement of the end cap relative to the body covers or uncovers the shoe. In covering the shoe, the body forces the shoe toward the central axis x-x such that at least a portion of the shoe protrudes into an annulus 216 that is substantially defined between the body and the post.

As skilled artisans will appreciate, the above described shoe 205 may be configured in various ways to enable depression by the end cap 206 and protrusion into the annulus 216. Examples include a sloped outer surface 235 (as shown) to ease passage of the endcap over the shoe and a sloped or non-sloped (as shown) inner surface 245 facing the x-x axis such that the shoe has a somewhat triangular cross-section (as shown). In some embodiments, the shoe is a wire-like or a hollow structure configured for variable engagement with the end cap and for protruding into the annulus 216.

In an embodiment, a shoe thickness "t5" at a leading end 220 of the shoe 205 is greater than a body wall thickness "t4" that is adjacent to the leading end of the shoe. Here, because the shoe has a thickness t5 that is greater than an adjacent thickness t4 of the body 204, an uncovered shoe that initially projects outside the body may finally protrude inside the body when it is depressed and covered by the end cap 206. Notably, the hinge 207 may resiliently hold the uncovered shoe 205 such that it projects outside the body. In some embodiments, the shoe may completely separate from the body when the shoe is depressed and covered by the end cap.

FIGS. 3A-G show another embodiment of a body clamp connector of the present invention 300A-G.

Figure 3A:
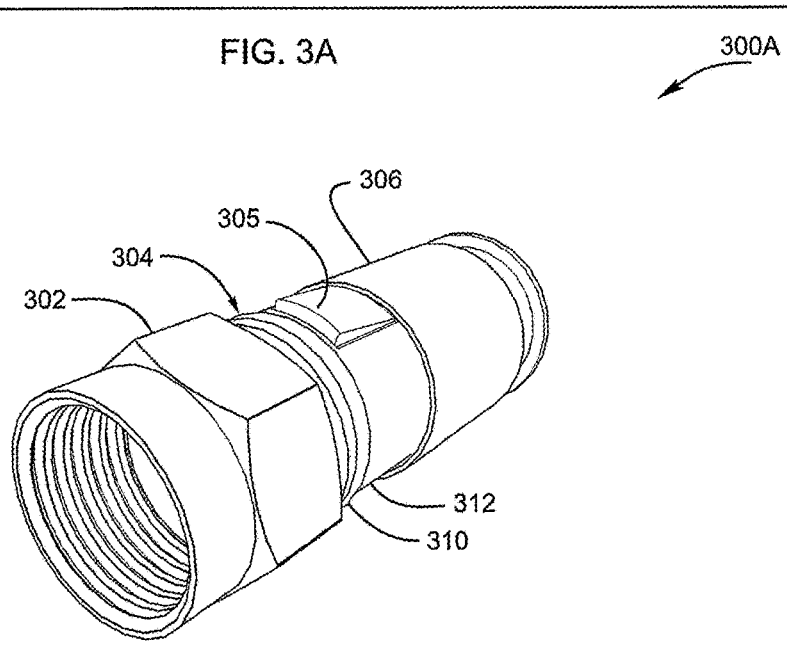
FIGS. 3A-I show another embodiment of the body clamp connector of FIG. 2A.
Figure 3B:
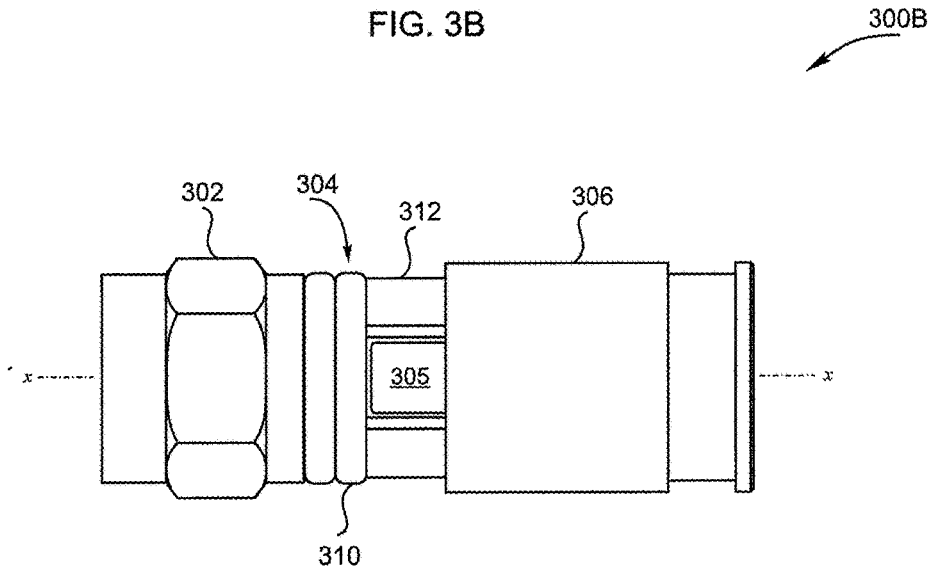

FIGS. 3A-B show perspective and side views of the body clamp connector 300A-B. As seen, the connector includes a fastener 302, a body 304 with a shoe 305, and an end cap 306. The body includes a body neck 310 and a body sleeve 312.

Figure 3C:
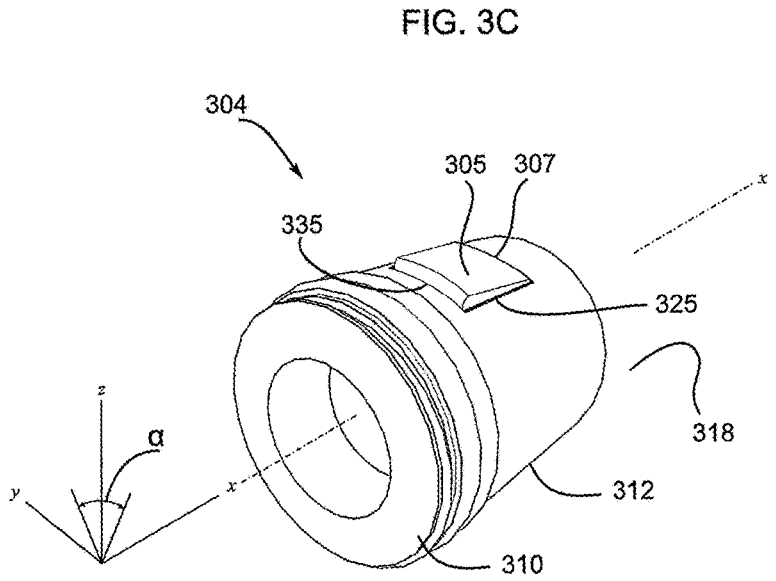
Figure 3D:
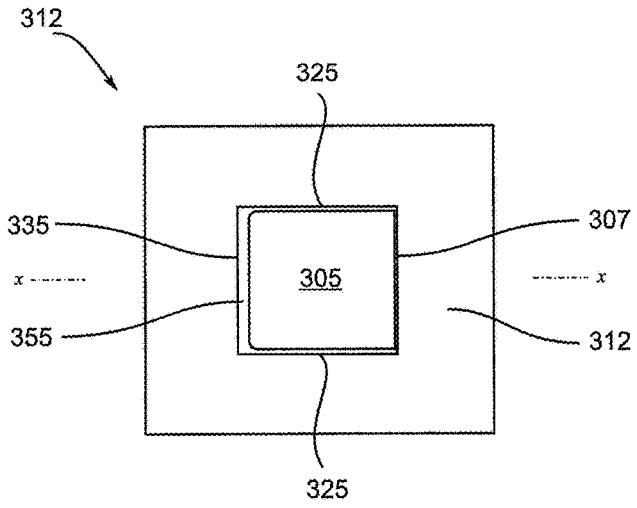

FIG. 3C shows a perspective view 300C of the body 304 and FIG. 3D shows a side view 300D of the body. The body includes a neck 310 and a body wall 318 forming a body sleeve 312. A shoe 305 is located at least in part in a window, for example an opening 355 in the body wall 318. In some embodiments a window may be defined at least in part by one or more of slots through the body wall. And in some embodiments a window may be defined at least in part by one or more thinned areas, for example web(s) or membrane(s) that may be frangible or not.

As shown, the shoe may extend via a hinge or web part 307 from the body wall. And, as shown, the body may include a hinged 307 shoe 305 which may be located about centrally in the body wall 318 and which may extend through an arc angle $\alpha$ (measured in a y-z plane) in a range of about 15 to 60 degrees with respect to a central axis x-x. In various embodiments, the body may include a plurality of shoes, for example two or four shoes, which may be arranged at about equal intervals around a circumference of the body.

Boundaries of the shoe 305 may include the hinge part 307, side boundaries 325, and a front boundary 335. The side boundaries may be formed by holes or slots through the body wall 318 or they may be webs or frangible webs that are broken when the shoe is depressed. The front boundary may be a hole or slot through the body wall or it may a web or a frangible web that is broken when the shoe is depressed. In some embodiments, the body is made from a resilient material or a resilient plastic material such as POM (Poly-OxyMethylene).

Figure 3E:
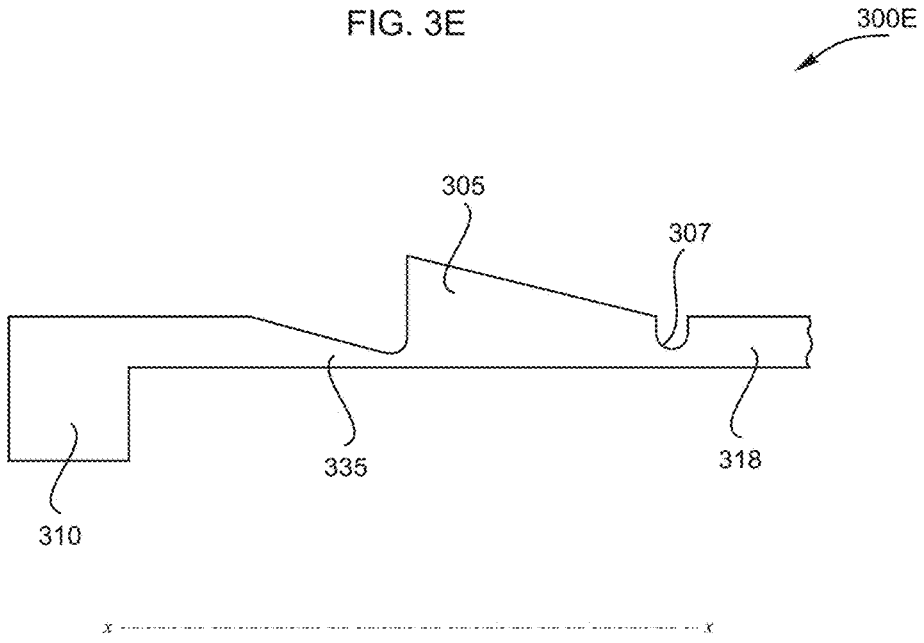
Figure 3F:
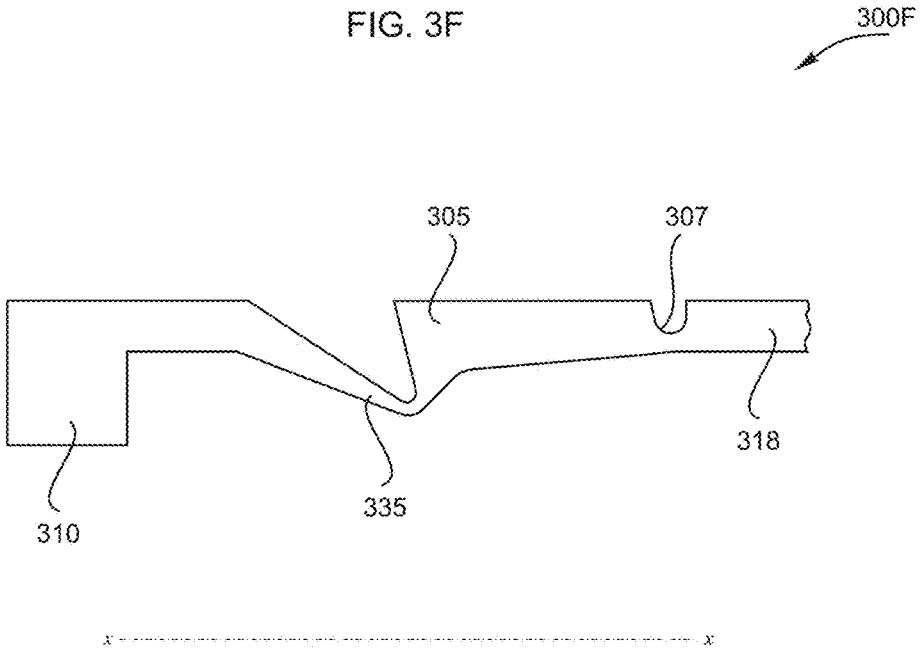

FIGS. 3E-F show a partial cross-sectional view of a body 312 having a window front boundary 335 and window rear boundary 307 that are webs or membranes that may be elastically or plastically stretched when the shoe 305 is depressed 300E-F. In some embodiments the corresponding window side boundaries 325 are similar webs or membranes. As skilled artisans will appreciate, a window 355 defined by front, rear, and side webs or membranes may provide a watertight boundary around the shoe 305 in in particular between the shoe and the body wall 318.

In FIG. 3E, the shoe 305 is not depressed 300E. As such, the front and rear membranes 335, 307 have not been deformed because the shoe has not been moved relative to the body wall 318.

In FIG. 3F, the shoe 305 is depressed 300F. As seen, the front and rear membranes 335, 307 are deformed when the shoe is depressed because the membranes are stretched between the shoe and the body wall 318. In the case of a watertight boundary around the shoe, window side boundaries 325 formed by membranes may be deformed in a similar manner.

Figure 3G:
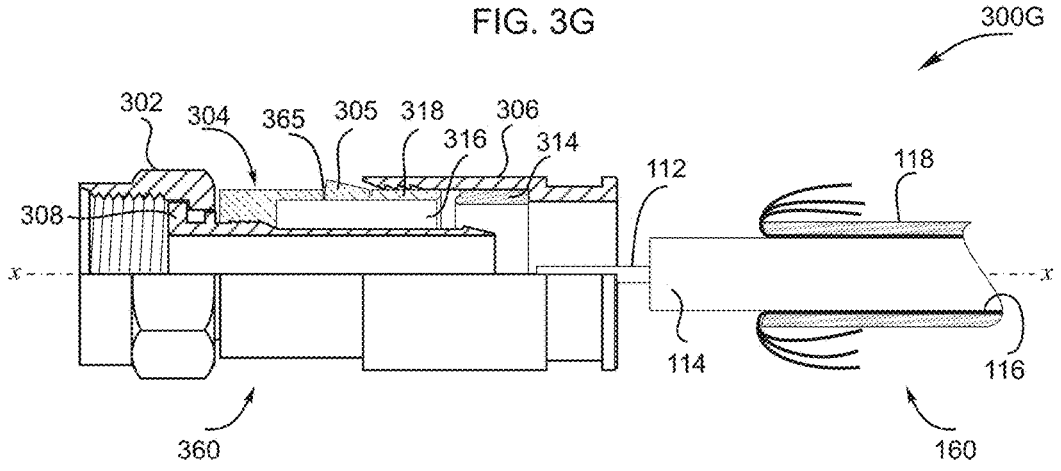
Figure 3H:
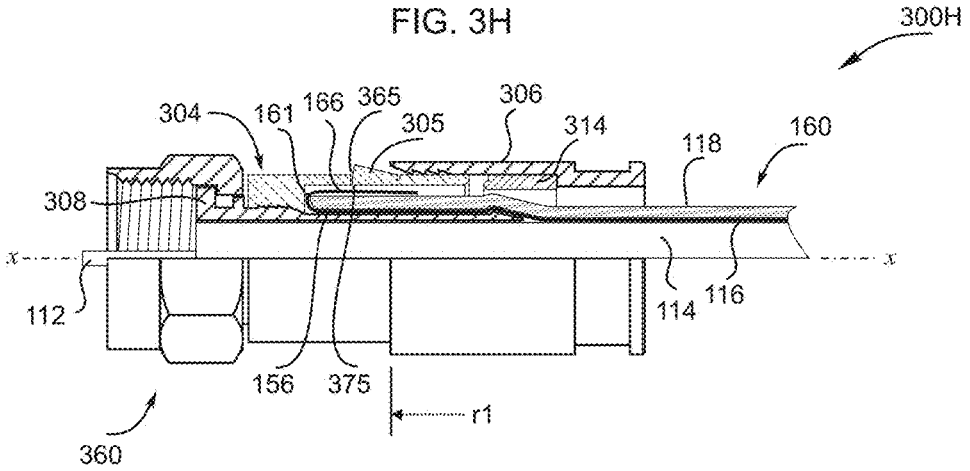
Figure 3I:
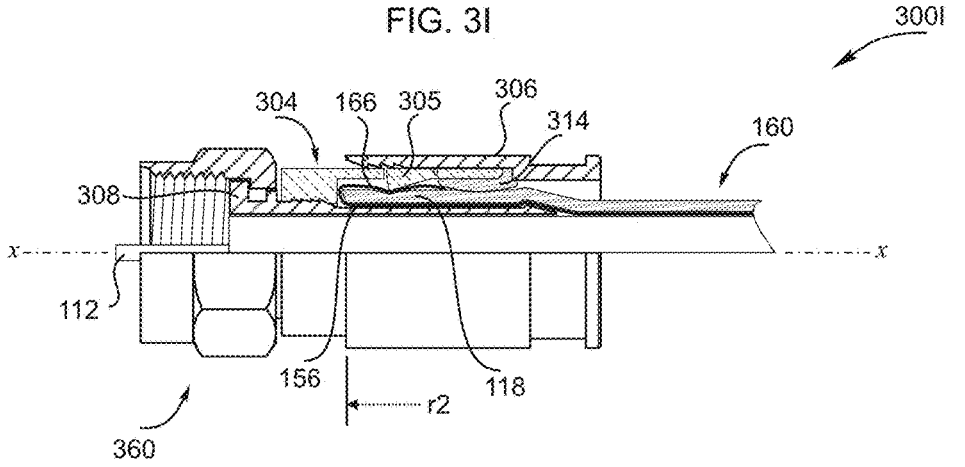

FIGS. 3G-I show a utility of an exemplary body clamp connector 300G-I.

FIG. 3G shows a body clamp connector 360 with a prepared end of a coaxial cable 160 partially inserted therein. The connector includes a post 308 that interengages a fastener 302 and a body 304. A shoe 305 is operable in a window 365 of a body wall 318 and an end cap 306 slidably engages the body.

FIG. 3H shows the body clamp connector 360 with the coaxial cable 160 fully inserted therein. As seen, a free end 161 of the coaxial cable 160 is inserted in an annular space 316 between the body 304 and the post 308 as the post is inserted between the cable dielectric 114 and the cable ground conductor 116.

Following this cable insertion, the cable ground conductor 116 has an inner portion or layer 156 that contacts the post 308. In some embodiments, the ground conductor is folded back over the cable jacket 118 such that a folded or outer portion or layer 166 of the ground conductor 116 lies between the jacket and the body 304. As such, one or two layers of the ground conductor may lie between the shoe 305 and the post 308.

FIG. 3I shows the body clamp connector 360 with the coaxial cable 160 fully inserted and with the cable 160 fixed within the connector.

The end cap 306 is movable from a first position "r1" behind the shoe 305 to a second position "r2" over or along the shoe. In various embodiments, in moving from the first to the second position, the end cap depresses the shoe and in some embodiments the end cap depresses and/or covers the shoe.

Fixation of the cable 160 in the connector 360 may occur via action of the shoe 305, via action of an optional wedge or plug 314, or via action of both the shoe and the wedge. Notably, the cable television industry and standards organizations such as SCTE (Society of Cable & Television Engineers) require that a connector remain attached to an installed coaxial cable despite applied forces tending to separate the one from the other (see e.g., ANSI/SCTE 99 2014).

For example, where an optional wedge or plug 314 is carried within the end cap, the wedge or plug may be forced between the cable and the body when the end cap is moved from the first r1 to the second position r2. The wedge may be made from a resilient material such as a plastic, elastomer, or polymer.

Fixation of the cable 160 in the connector 360 may also occur via a binding action of the movable shoe 305. In an embodiment, when the shoe is depressed by movement of the end cap 306 along the body 304, a corner or projection of the shoe 375 may press directly or indirectly against the coaxial cable, for example directly and/or indirectly against the ground conductor(s) 156, 166 for urging one or both of the ground conductors toward the post. Frictional and binding forces may include, inter alfa, any of shoe to cable and cable to post frictional and binding forces.

Continuity of a ground path through the connector may also be improved when the cable 160 is fixed in the connector 360 by action of the movable shoe 305. Such ground paths include i) cable ground conductor 116, 156 to electrically conductive post 308 to a female connector ground and ii) cable ground conductor 116, 156 to electrically conductive post 308 to an electrically conductive fastener 302, to a female connector ground.

For example, when the shoe presses the coaxial cable 160 toward the post, the inner ground conductor layer 156 may be pressed into firm and/or continuous physical and electrical contact with an electrically conductive post 308.

And, for example, where the body wall 318 and shoe 305 provide for electrical conduction therethrough, a ground path may be established from the cable ground conductor 116, 166 to the shoe, to the body wall, and to one or more of the post and an electrically conductive fastener 302 when the shoe is pressed against and physically contacts the cable ground conductor 116, 166.

As skilled artisans will recognize, utilization of at least some embodiments of the body clamp connector technology of the present invention is not limited to use with a particular coaxial connector such as an F type coaxial cable connector. Rather, coaxial connectors having a body encircling a post may be fixed to a coaxial cable when the body includes shoe(s) and an end cap provides a means to depress the shoe(s) during termination of the coaxial cable. For example, selected MCX connectors (micro-coaxial cable connectors) may be configured to use the body clamp connector technology of the present invention.

Figure 4A:
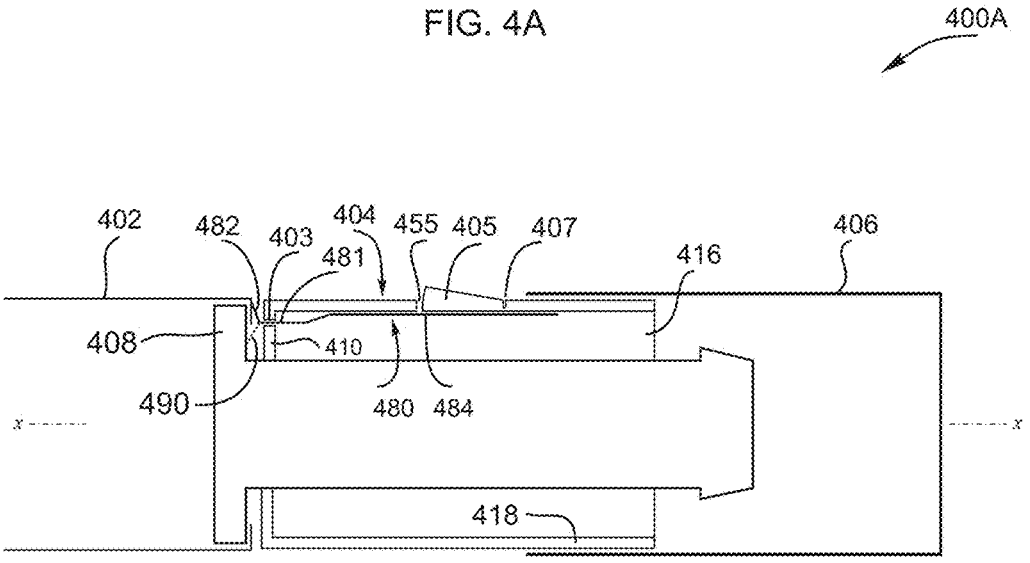
FIGS. 4A-F show another embodiment of the body clamp connector of FIG. 2A.

FIG. 4A shows another embodiment of a body clamp connector 400A that includes a continuity bus. The connector includes a fastener 402, a body 404, an end cap 406, and a post 408. Similar to the connector of FIG. 2A, a shoe 405 in a window 455 of a body wall 418 may be depressed into an annulus 416 at least partially defined between the post 408 and the body 404 when the end cap slides along the body and depresses the shoe. Here, the shoe may be coupled to the body via a hinge such as an integral hinge 407.

Unlike the connector of FIG. 2A, the connector of FIG. 4A includes an exemplary continuity bus 480. The continuity bus is an electrical conductor of one or multiple parts. For example, the continuity bus may be an elongated metallic or copper/copper alloy part that extends from within the annulus 416, through a passage 403 in the body neck 410, and into a space bounded at least in part by portions of the body 404 and one or both of the fastener 402 and the post 408.

For descriptions of continuity bus connectors and connector parts including continuity bus designs, see U.S. patent application Ser. No. 14/791,395 filed Jul. 3, 2015, U.S. patent application Ser. No. 14/540,995 filed Nov. 13, 2014, U.S. patent application Ser. No. 14/245,919 filed Apr. 4, 2014, and U.S. Prov. Pat. App. No. 61/822,834 filed May 13, 2013, all of which are incorporated herein in their entireties and for all purposes.

As shown in the figure, the continuity bus 480 includes an arm 481 inserted in the body passage 403. The arm interconnects a nib or forward contact 482 and a base or rear contact 484.

The nib or portion thereof 482 may contact the fastener 402 and/or the nib or portion thereof 490 may contact the post 408. Notably, the nib may be bent away from 482 and/or toward 490 the central axis x-x as shown. This bend may be formed during assembly of the connector, for example when a body with a nib protruding therefrom is pushed onto a post 408. In one or more embodiments, the fastener, post, and nib are designed such that the nib contacts the fastener and/or the post. As skilled artisans will appreciate, a bend at the nib may be used to provide a flexible joint and a resilient nib contacting means.

In various embodiments, the continuity bus base 484 is located beneath the shoe 405 such that movement of the shoe toward the axis x-x presses the base into contact with a coaxial cable 160 outer conductor 116 (see e.g., coaxial cable 160 of FIG. 3D). Notably, the base may be permanently or resiliently deformed by the pressing action of the shoe. A ground path through the connector or a portion thereof is formed when the continuity bus 480 electrically interconnects a coaxial cable 160 outer conductor 116 with an electrically conductive fastener 402 and/or an electrically conductive post 408.

The continuity bus 480 may include a plurality of arms 481 for insertion in a plurality of passages 403 in a neck 410 of the body 404 such that a corresponding plurality of nibs 482 projects from the neck, for example project from the neck and contact the fastener 402.

Skilled artisans will recognize that embodiments of the connector of FIG. 4A may utilize electrically conductive and electrically non-conductive parts. For example, where a conductive post is used, a ground path utilizing the post may be formed between the ground conductor(s) of a coaxial cable such as a ground conductor braid 116 and a grounded portion or face of a mating connector that comes into contact with the post. And, for example, where a non-conductive post is used, a ground path utilizing the continuity bus 480 and the fastener 402 may be formed between the ground conductor(s) of a coaxial cable such as a ground conductor braid 116 and a grounded portion or threads of a mating connector.

Figure 4B:
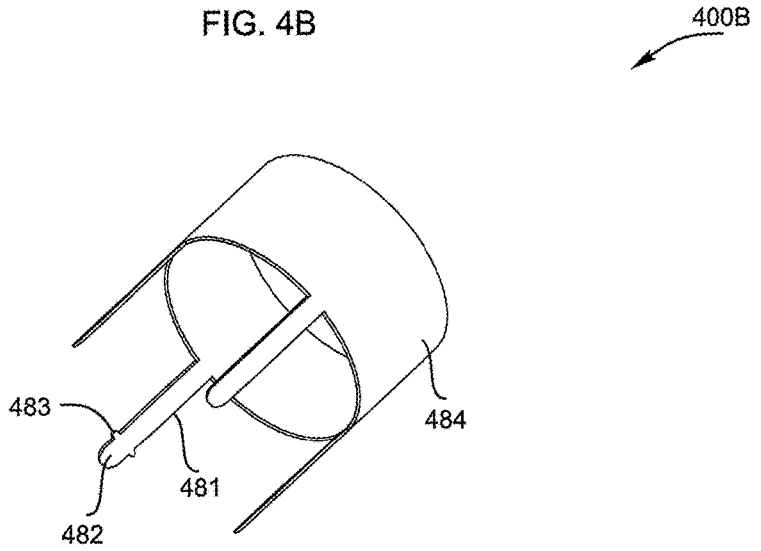
Figure 4C:
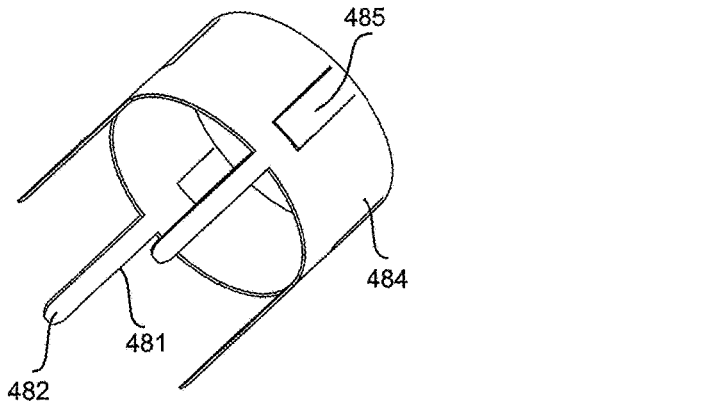

FIGS. 4B-C show multi-arm continuity bus embodiments 400B-C.

FIG. 4B shows a continuity bus 400B with a cylindrical base 484 and four arms 481 extending from the base that are spaced at about even intervals around a base circumference. At the free end of each arm is a nib 482. In some embodiments, one or more arm spurs 483 provide a means for anchoring the arm within a respective body neck passage 403.

FIG. 4C shows a continuity bus 400C with a cylindrical base 484 and four arms 481 extending from the base spaced at about even intervals around a base circumference. At the free end of each arm is a nib 482. In some embodiments, one or more base tabs 485 provide a means for anchoring the base within the body 404.

Figure 4D:
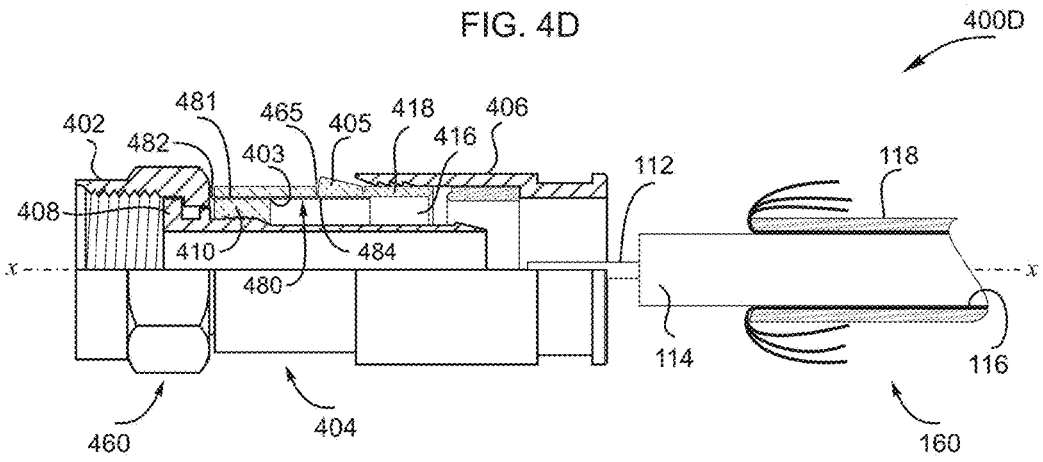
Figure 4E:
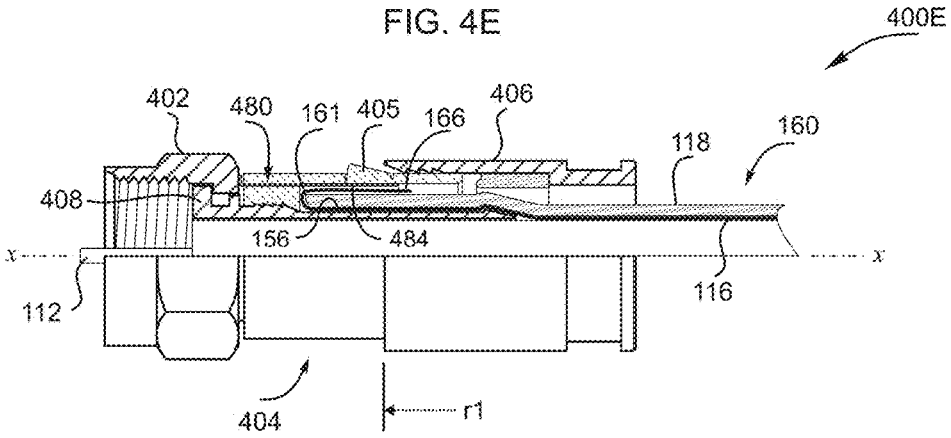
Figure 4F:
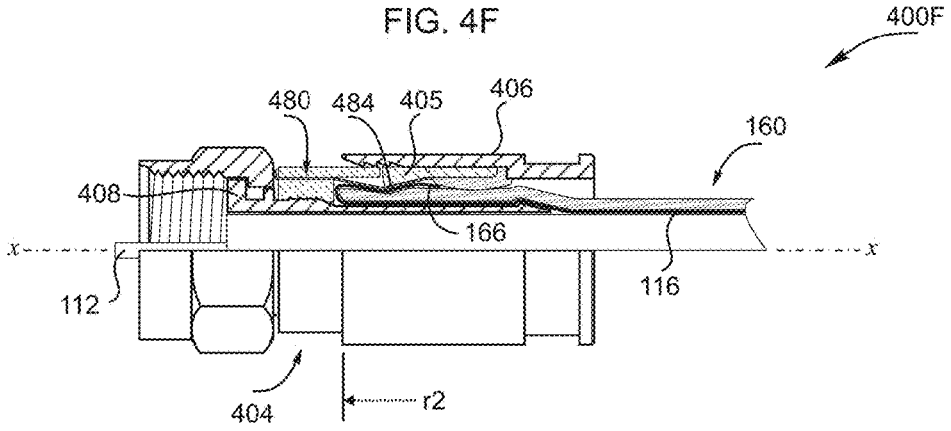

FIGS. 4D-F show a utility of an exemplary body clamp connector with a continuity bus 400D-F.

FIG. 4D shows a body clamp connector 460 with a prepared end of a coaxial cable 160 partially inserted therein. The connector includes a post 408 that interengages a fastener 402 and a body 404. A shoe 405 is operable in a window 465 of a body wall 418 and an end cap 406 slidably engages the body. As seen, a continuity bus 480 is inserted in the body. The continuity bus has four arms 481 that extend through passages 403 of the body neck 410. Nibs 482 at the ends of the arms are for contacting the fastener 402 and/or the post 408 while the base from which the arms extend is for contacting the outer or ground conductor 116 of a coaxial cable.

FIG. 4E shows the body clamp connector 460 with the coaxial cable 160 fully inserted. As seen, a free end 161 of the coaxial cable 160 is inserted in the connector 460 such that the center conductor 112 and dielectric 114 enter the post 408 while the ground conductor braid 116 and the jacket 118 enter an annular space 416 between the body 404 and the post.

Applicant notes that the coaxial cable ground conductor 116 may comprise one or two layers of ground conductor braid which typically become indistinguishable if they are folded back over the jacket. For example: (i) where a dual (inner foil+outer braid) shield cable is used, there is but a single ground conductor braid; (ii) where a tri shied (inner foil+middle braid+outer foil) cable is used, there is but a single ground conductor braid; (iii) where a quad shield (inner foil+1$^{st}$ intermediate braid+intermediate foil+outer braid) cable is used, there are two ground conductor braids. Where an inner foil layer is wrapped onto the dielectric, the foil layer may be inserted into the post along with the dielectric and center conductor. And, where an intermediate foil layer separates two braid layer portions that are to be folded back over the jacket, it may be removed such that the folded back braid layers become indistinguishable.

Following this cable insertion, the cable ground conductor 116 has an inner portion or layer 156 that presses against the post. The ground conductor may be folded back over the cable jacket 118 such that a folded or outer portion or layer 166 of the ground conductor 116 lies between the jacket and the base 484 of the continuity bus 480. For example, the continuity bus base 484 may encircle or partially encircle an outer or wrapped layer 166 of the coaxial cable ground conductor 116.

FIG. 4F shows the body clamp connector 460 with the coaxial cable 160 fully inserted and with the cable 160 fixed within the connector.

The end cap 406 is movable from a first position "r1" behind the shoe 405 to a second position "r2" over or along the shoe. In various embodiments, in moving from the first to the second position, the end cap depresses the shoe and in some embodiments the end cap depresses and/or covers the shoe. When the shoe 405 moves toward the central axis x-x, the continuity bus 480 base 484 is pushed into firm physical contact with the outer layer 166 of the coaxial cable ground conductor 116. For example, a radially inward deformation of the base 484 may be used to close a gap, if such a gap exists, between the base and the coaxial cable ground conductor 116 outer layer 166.

When the continuity bus base 484 firmly contacts the ground conductor wrapped layer 166, the continuity bus base 484 provides a portion of a connector 460 ground path.

This ground path extends from cable ground conductor 116, to continuity bus 480, to one or both of an electrically conductive fastener 402 and an electrically conductive post 408, to a ground surface or terminal of a mating connector such as a female F connector port (not shown).

FIGS. 5A-E show operation of an exemplary body clamp connector with a continuity bus 500A-E.

Figure 5A:
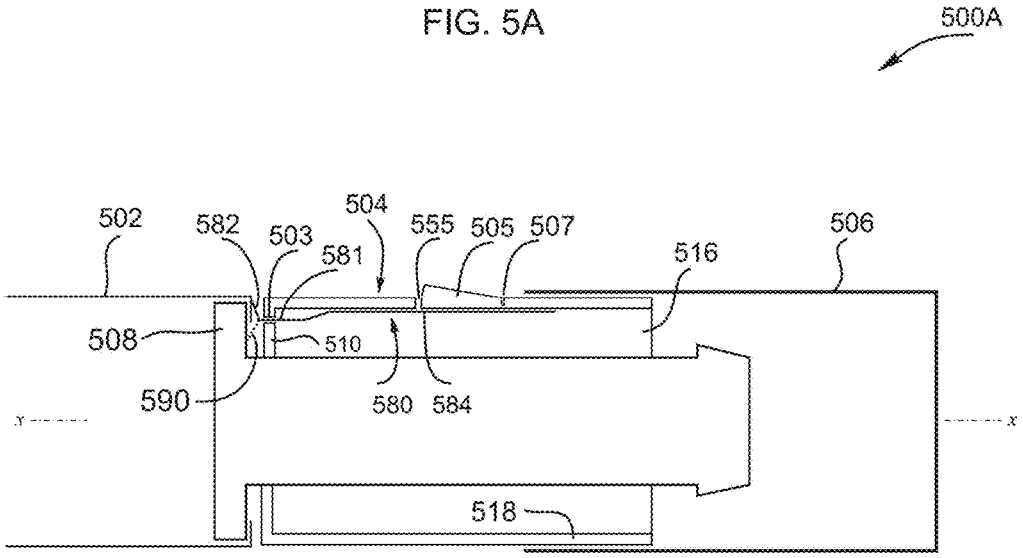
FIGS. 5A-E show another embodiment of the body clamp connector of FIG. 2A.

FIG. 5A shows an embodiment of a body clamp connector 500A that includes a continuity bus. The connector includes a fastener 502, a body 504, an end cap 506, and a post 508. Similar to the connector of FIG. 2A, a shoe 505 in a window 555 of a body wall 518 may be depressed into an annulus 516 at least partially defined between the post 508 and the body 504 when the end cap slides along the body and depresses the shoe. Here, the shoe may be coupled to the body via a hinge such as an integral hinge 507.

Unlike the connector of FIG. 2A, the connector of FIG. 5A includes an exemplary continuity bus 580. The continuity bus is an electrical conductor of one or multiple parts. For example, the continuity bus may be an elongated metallic or copper/copper alloy part that extends from within the annulus 516, through a passage 503 in the body neck 510, and into a space bounded at least in part by portions of the body 504 and one or both of the fastener 502 and the post 508.

As shown in the figure, the continuity bus 580 includes an arm 581 inserted in the body passage 503. The arm interconnects a nib or forward contact 582 and a base or rear contact 584.

The nib or portion thereof 582 may contact the fastener 502 and/or the nib or portion thereof 590 may contact the post 508. Either of the nib portions 582, 590 may be optional. Notably, the nib may be bent away from 582 and/or toward 590 the central axis x-x as shown. This bend may be formed during assembly of the connector, for example when a body with a nib protruding therefrom is pushed onto a post 508. In one or more embodiments, the fastener, post, and nib are designed such that the nib contacts the fastener and/or the post. As skilled artisans will appreciate, a bend at the nib may be used to provide a flexible joint and a resilient nib contacting means.

In various embodiments, the continuity bus base 584 is located beneath the shoe 505 such that movement of the shoe toward the axis x-x presses the base into contact with a coaxial cable 160 outer conductor 116 (see e.g., coaxial cable 160 of FIG. 3E). Notably, the base may be permanently or resiliently deformed by the pressing action of the shoe. A ground path through the connector or a portion thereof is formed when the continuity bus 580 electrically interconnects a coaxial cable 160 outer conductor 116 with an electrically conductive fastener 502 and/or an electrically conductive post 508.

The continuity bus 580 may include a plurality of arms 581 for insertion in a plurality of passages 503 in a neck 510 of the body 504 such that a corresponding plurality of nibs 582 projects from the neck, for example project from the neck and contact the fastener 502.

Figure 5B:
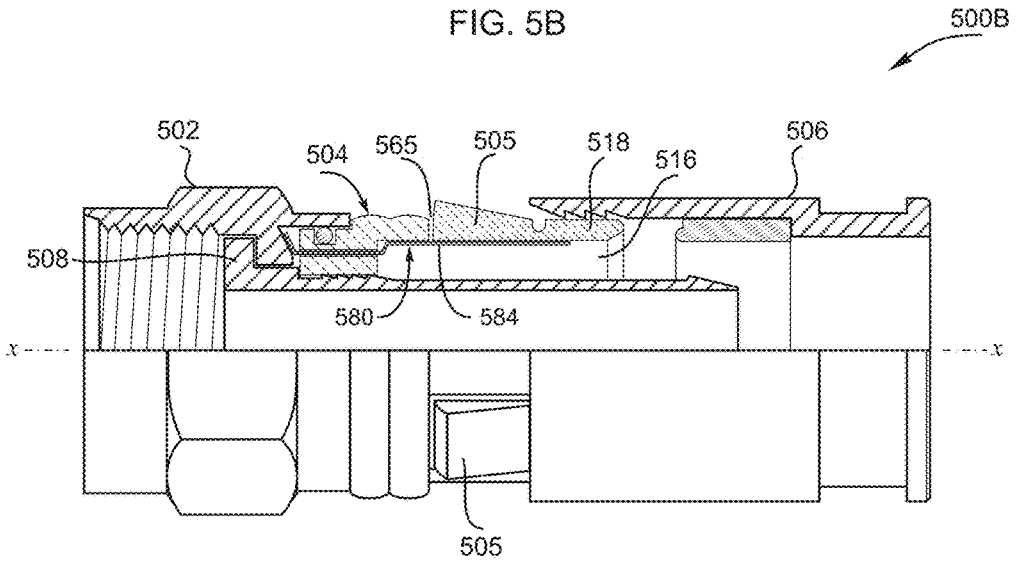

The connector of FIG. 5B is similar to the connector of FIG. 5A. It includes an electrically conductive fastener 502, an electrically insulating body 504, an end cap 506, and an electrically conductive post 508 coaxially arranged about a central axis x-x. Around a circumference of the body are plural shoes 505 operable in plural body wall 518 windows 565. The post 508 and the body 504 substantially define an annulus 516 therebetween for receiving a jacket 118 portion and a ground conductor 116 portion of a coaxial cable 160 (see e.g., coaxial cable 160 of FIG. 3E). As will be appreciated from applicant's disclosure, a body similar to that of FIGS. 3E-F might also be used.

Extending from the fastener 502 and into the annulus 516 is a continuity bus 580 included in a connector ground path extending between the fastener and an outer conductor 116 of a coaxial cable 160. The continuity bus has a base portion 584 in the annulus such that movement of the shoe toward the connector centerline x-x presses the continuity bus base toward the centerline and into physical contact with the ground conductor 116 of the coaxial cable (see e.g., coaxial cable 160 of FIG. 3E).

Figure 5C:
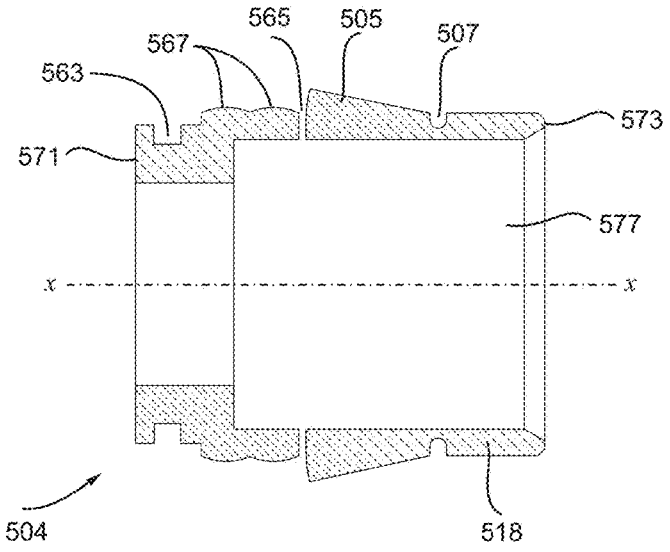

The connector body of FIG. 5C is generally cylindrical in shape and extends between a forward end 571 and a rear end 573. Near its forward end, the body includes an O-Ring groove 563 and one or more circumferential raised surfaces 567 for sealing against the end cap 506. Near its rear end 573, the body opening 577 is for receiving portions of the coaxial cable 160. Between the body forward and rear ends, depressible shoes 505 are located in windows 565 in the body wall 518. In some embodiments a hinge or web 507 may extend between the shoe 505 and the body sidewall 518.

Figure 5D:
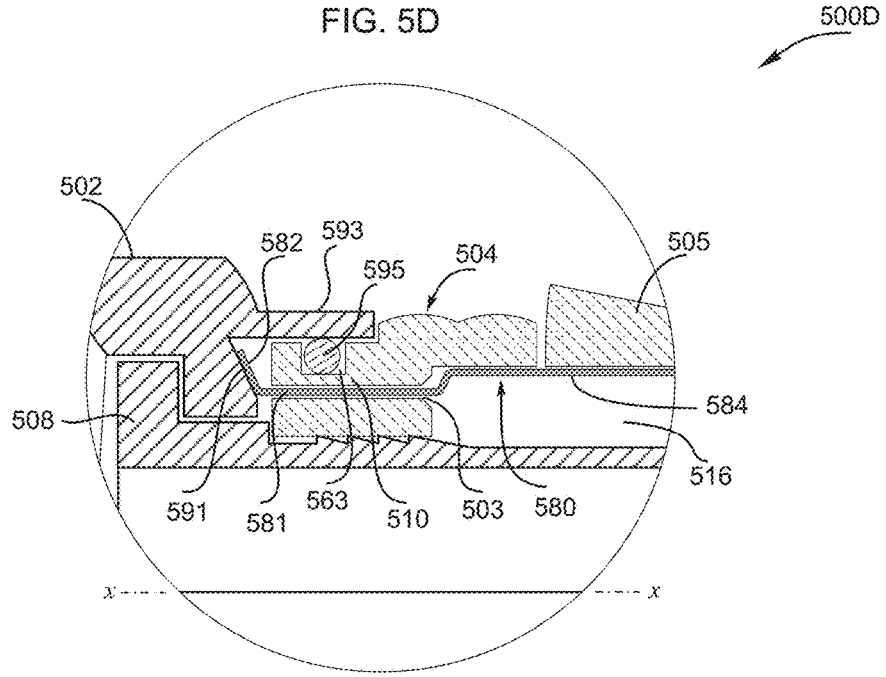
Figure 5E:
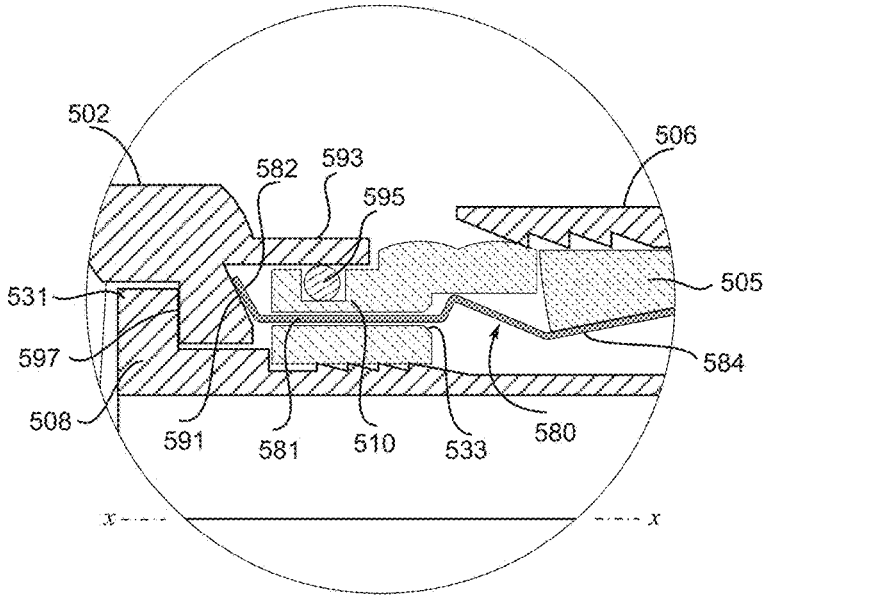

FIGS. 5D-E show exploded views of shoe and continuity bus operation 500D-E. In FIG. 5D, the shoe 505 is not depressed by the end cap 506 and the continuity bus is not moved toward the centerline x-x of the connector. In FIG. 500E, the shoe 505 is depressed by the end cap 506 and the continuity bus is moved toward the centerline x-x of the connector. For clarity, no coaxial cable 160 is shown.

As seen in FIG. 5D, the fastener 502 includes a back wall such as a sloped back wall 591 on which a nib 582 of the continuity bus 580 may press or force a forward wall 597 of the fastener toward or against the post 508 or a flange 531 of the post. As skilled artisans will appreciate, firm contact between an electrically conductive fastener and post provides a ground path from a coaxial cable ground conductor 116 bearing on the post to a ground part of a mating connector (not shown) via the post and fastener. In some embodiments, the fastener includes a rear shroud 593 for engaging an O-Ring 595 located in the body groove 563.

Continuity bus arms 581 extend through a neck 510 of the body 504 via body neck passages 503 which may include a tapered entry 533. Trailing from these arms is a continuity bus base 584 that is inserted in the annulus 516.

In comparing FIGS. 5D-E, it is seen that moving the end cap 506 to depress and cover the shoe 505, the shoe is pressed against the continuity bus base 584 and both are pressed toward the connector centerline x-x. Deformation of the continuity bus base during this pressing action pushes the continuity bus base to contact the ground conductor 116 of the coaxial cable 160 (see e.g., coaxial cable 160 of FIG. 3E).

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

The invention claimed is:

1. A connector is a male coaxial connector comprising:

a post that is hollow interengages a fastener and a body, the post, fastener and body in coaxial arrangement;

an annular space between the body and the post;

the annular space for receiving a coaxial cable ground conductor;

a shoe moveable in a body sidewall window; and, the shoe for urging the coaxial cable ground conductor toward the post;

wherein an end cap slidably engages the body and movement of the end cap toward the fastener moves the shoe toward the post with the coaxial cable ground conductor therebetween.

2. The connector of claim 1 wherein moving an endcap from a first position to a second position squeezes a coaxial cable insulating jacket between the shoe and the post.

3. The connector of claim 1 wherein moving the end cap from a first position to a second position forces the coaxial cable ground conductor against the post for fixing the coaxial cable within the connector.

4. The connector of claim 1 further comprising:

an elongated electrical conductor having an arm interconnecting a base and a nib;

the base inserted in the annular space, the body penetrated by the arm, and the nib located in a space between the body and the fastener; and, at least a portion of the base located between the shoe and the coaxial cable ground conductor of the coaxial cable;

wherein moving the end cap from a first position to a second position squeezes the base and the coaxial cable ground conductor between the shoe and the post.

5. The connector of claim 4 further comprising:

a body neck wherein the body is penetrated by the arm when the arm passes through the body neck.

6. The connector of claim 4 wherein the elongated conductor is a part of a ground path through the connector.

7. The connector of claim 4 wherein a ground path through the connector is formed by the elongated conductor, the fastener, and an electrical connection therebetween.

8. The connector of claim 4 wherein a ground path through the connector is formed by the elongated conductor, the post, and an electrical connection therebetween.

9. The connector of claim 4 wherein a ground path through the connector is formed by the post alone.

10. A method of engaging a coaxial connector and a coaxial cable, the method comprising the steps of:

providing a coaxial connector having a post that couples to a rotatable fastener and a body, the post, fastener, and body in coaxial arrangement about a central axis;

providing an annular space substantially defined between a body sidewall and the post, the annular space receiving a coaxial cable ground conductor; and, locating a shoe radially movable with respect to the post in the body sidewall, a portion of the shoe projecting from the body sidewall;

wherein slidably engaging an end cap with the body and moving the end cap toward the fastener moves the shoe toward the post.

11. The method of claim 10 further comprising the step of:

squeezing a coaxial cable insulating jacket between the shoe and the post when an endcap is moved from a first position to a second position.

12. The method of claim 10 further comprising the steps of:

providing a continuity bus with first and second ends;

contacting the fastener with the first end of the continuity bus; and, electrically interconnecting the fastener and the coaxial cable ground conductor by urging the second end of the continuity bus to contact the coaxial cable ground conductor when the end cap slides over the projecting portion of the shoe.

13. The method of claim 11 further comprising the step of:

forcing the coaxial cable ground conductor against the post for fixing the coaxial cable within the connector when the endcap is moved from the first position to the second position.

14. The method of claim 11 wherein a continuity bus passes through an end wall of the body.

15. The method of claim 14 wherein the continuity bus urges the fastener against a flange of the post.

16. An F-Type male coaxial cable connector for receiving a coaxial cable, the connector comprising: a fastener that is an electrically conductive fastener and a body that is an electrical insulator in coaxial arrangement about a longitudinal central axis; a first ground conductor, and a second ground conductor; the second ground conductor spaced apart from a post; a first ground path through the connector that includes the first ground conductor; a second ground path through the connector that excludes the first ground conductor and includes the second ground conductor; the first ground conductor for longitudinally extending between a coaxial cable jacket and the longitudinal central axis; and, the second ground conductor for longitudinally extending between the coaxial cable jacket and the body; a body sidewall shoe; and, the shoe moveable to urge at least a portion of the second ground conductor toward the longitudinal central axis.

17. The connector of claim 16 wherein the first ground conductor is a post.

18. The connector of claim 17 wherein the second ground conductor is a continuity bus.

19. The connector of claim 18 wherein the continuity bus passes through an end wall of the body.

20. The connector of claim 19 wherein the continuity bus urges the fastener against a flange of the post.

21. The connector of claim 20 further comprising:

an end cap coupled to the connector; and, the end cap movable relative to the body for advancing at least a portion of a shoe toward the longitudinal central axis.

* * * * *